US011685564B2

(12) United States Patent
Hu

(10) Patent No.: US 11,685,564 B2
(45) Date of Patent: Jun. 27, 2023

(54) ROTATIONAL AND TRANSLATIONAL PACKING DEVICE AND PACKING METHOD THEREOF

(71) Applicant: QINGDAO SACPACK INTELLIGENT EQUIPMENT CO., LTD., Qingdao (CN)

(72) Inventor: Xiangrong Hu, Qingdao (CN)

(73) Assignee: QINGDAO SACPACK INTELLIGENT EQUIPMENT CO., LTD., Qingdao (CN)

( * ) Notice: Subject to any disclaimer, the term of this patent is extended or adjusted under 35 U.S.C. 154(b) by 0 days.

(21) Appl. No.: 17/917,192

(22) PCT Filed: Jul. 16, 2020

(86) PCT No.: PCT/CN2020/102229
§ 371 (c)(1),
(2) Date: Oct. 5, 2022

(87) PCT Pub. No.: WO2021/243814
PCT Pub. Date: Dec. 9, 2021

(65) Prior Publication Data

US 2023/0143931 A1 May 11, 2023

(30) Foreign Application Priority Data

Jun. 3, 2020 (CN) ..... 202010496062.1

(51) Int. Cl.
*B65B 11/02* (2006.01)
*B65B 13/10* (2006.01)
(Continued)

(52) U.S. Cl.
CPC ..... *B65B 13/10* (2013.01); *B65B 13/187* (2013.01); *B65B 57/12* (2013.01)

(58) Field of Classification Search
CPC ..... B65B 13/10; B65B 13/18; B65B 13/187; B65B 57/10; B65B 57/12; B65B 11/025; B65B 11/585; B65B 2210/18
See application file for complete search history.

(56) References Cited

U.S. PATENT DOCUMENTS 7,111,439 B2 * 9/2006 Suolahti ..... B65B 11/006 53/399
7,784,252 B2 * 8/2010 Cere' ..... B65B 41/14 53/461
(Continued)

FOREIGN PATENT DOCUMENTS

CN 101663202 A 3/2010
CN 106742162 A 5/2017
(Continued)

*Primary Examiner* — Andrew M Tecco
(74) *Attorney, Agent, or Firm* — Standley Law Group LLP; Adam Smith

(57) ABSTRACT

A rotary translational strapping apparatus and strapping method thereof are provided including a support frame, a rotary module, and a translational strapping module, the rotary module includes a rotary guide, a rotary frame, and a first driving mechanism, the rotary guide is disposed on top of the support frame, the rotary frame is rotatably disposed on the rotary guide, the first driving mechanism is used for driving the rotary frame to rotate relative to the rotary guide. The translational strapping module includes a sliding mount, a strapping head, a strapping chute, and a second driving mechanism. The sliding mount is slidably disposed on the rotary frame.

9 Claims, 6 Drawing Sheets

(51) Int. Cl.
*B65B 13/18* (2006.01)
*B65B 57/12* (2006.01)

(56) References Cited

U.S. PATENT DOCUMENTS

| | | | | |
|---|---|---|---|---|
| 7,854,105 | B2 * | 12/2010 | Zitella | B65B 57/04 53/399 |
| 9,434,490 | B2 * | 9/2016 | Magri | B65B 13/12 |
| 11,427,356 | B2 * | 8/2022 | Cere' | B65B 11/585 |
| 11,472,581 | B2 * | 10/2022 | Cere' | B65B 11/585 |
| 2008/0229714 | A1 * | 9/2008 | Zitella | B65B 11/025 53/449 |
| 2013/0255186 | A1 * | 10/2013 | Magri | B65B 13/12 53/218 |
| 2018/0050832 | A1 * | 2/2018 | Hurme | B65B 57/12 |

FOREIGN PATENT DOCUMENTS

| | | | | |
|---|---|---|---|---|
| CN | 207523996 | U | | 6/2018 |
| CN | 207536186 | U | | 6/2018 |
| CN | 209956286 | U | * | 1/2020 |
| CN | 209956286 | U | | 1/2020 |
| CN | 210479117 | U | | 5/2020 |
| EP | 2647575 | A1 | | 10/2013 |
| JP | H02233313 | A | | 9/1990 |

* cited by examiner

ROTATIONAL AND TRANSLATIONAL PACKING DEVICE AND PACKING METHOD THEREOF

CROSS-REFERENCE TO RELATED APPLICATIONS

This application claims priority to International Application No. PCT/CN2020/102229, filed on Jul. 16, 2020, which claims the priority benefit of China Patent Application No. 202010496062.1, filed on Jun. 3, 2020, the contents of the above identified applications are incorporated herein by reference in their entireties.

TECHNICAL FIELD

The present invention relates to the technical field of a strapping machines, in particular to a rotary translational strapping apparatus and strapping method thereof.

BACKGROUND ART

At present, with the continuous development of the logistics industry, goods are often required to be strapped with a strapping tape prior to shipment. With the popularization of automated strapping techniques, strapping machines with automated strapping capabilities are widely used. For example, Chinese Patent No. 200880103087.8 discloses a strapping machine, which mainly uses a strapping tape for strapping goods. Among them, the strapping machine is usually configured with components such as a strapping head, a strapping chute, and a strapping material dispenser, wherein the strapping head has an ability to guide strapping material (such as a strapping tape) into and out of the strapping chute and to be able to grasp, tighten, cut, and weld the strapping material. For the strapping head, it usually includes a tensioning assembly and a sealing assembly, in actual use, the tensioning assembly is configured with tensioning jaws to draw and apply a tensioning force to the strapping material, while the sealing assembly welds and cuts the strapping material mainly through the sealing element and cutter.

However, in the process of strapping the goods with a conventional strapping machine, the goods usually need to be wrapped with multiple strapping tapes, and the front and rear and left and right sides of the goods need to be strapped respectively. In order to meet the strapping requirements of the goods in different directions, it is necessary to configure two strapping machines on the conveyor belt, one of which performs the strapping operation of the front and rear strapping belts, and the other performs the operation of the front and rear strapping belts. The configuration of two strapping machines increases the operating cost on the one hand, and occupies a large factory area on the other hand.

SUMMARY

Therefore, how to design a strapping technology with small footprint and low operating cost is the technical problem to be solved by the present invention.

The present invention provides a rotary translational strapping apparatus and strapping method thereof, which can reduce the footprint of the apparatus and reduces operating costs.

The present invention provides a rotary translational strapping apparatus, comprising:

a support frame;

a rotary module comprising a rotary guide, a rotary frame and a first driving mechanism, the rotary guide is disposed on a top of the support frame, the rotary frame is rotatably disposed on the rotary guide, the first driving mechanism is used for driving the rotary frame to rotate relative to the rotary guide;

a translational strapping module comprising a sliding mount, a strapping head, a strapping chute and a second driving mechanism, the sliding mount is slidably disposed on the rotary frame, the strapping head is disposed on the sliding mount and which is movable up and down, the strapping chute is disposed on the sliding mount, the second driving mechanism is used to drive the sliding mount to reciprocate relative to the rotary frame, wherein a first detection module for detecting a size of items to be strapped is disposed on the sliding mount.

Further, the sliding mount is further provided with a second detection module for detecting a position of a forklift hole on a tray carrying items to be strapped.

Further, the rotary guide comprises a swivel bearing, the fixed portion of the swivel bearing is disposed on a top of the support frame, and the rotary frame is disposed on a rotating portion of the swivel bearing.

Further, the rotary guide further comprises an annular slide rail, the annular slide rail is surrounded on an exterior of the swivel bearing and is disposed on a top of the support frame, the rotary frame is also slidably disposed on the annular slide rail.

Further, the rotary frame includes two cross beams and at least one reinforcement beam, the reinforcement beam is connected between the two cross beams; each of the cross beams is provided with a guide rail, and the sliding mount is slidably disposed on the guide rails.

Further, two ends of the sliding mount are provided with downwardly extending connection brackets; the strapping chute comprises two side belt grooves distributed on both sides of the strapping head and are disposed oppositely, the side belt grooves are vertically disposed on the connection brackets on the respective sides; wherein, a lower end of at least one of the side belt grooves is provided with a laterally disposed bottom belt groove.

Further, a bottom of the connection bracket is provided with a laterally arranged second telescopic mechanism, and the bottom belt groove is provided on a moving portion of the second telescopic mechanism.

Further, the sliding mount is further provided with a third telescopic mechanism and a lifting platform, the third telescopic mechanism is provided vertically on the sliding mount, the lifting platform is provided on a moving portion of the third telescopic mechanism, the strapping head is provided on the lifting platform.

Further, a film wrapping module is provided on the connection brackets for conveying the film outwardly and wrapping the film around the items to be strapped.

The present invention also provides a strapping method for a rotary translation baler apparatus mentioned above, comprising: conveying the items to be strapped below the support frame, moving the translational strapping module in a first direction, and performing multiple strapping operations on the item, and then rotating the translational strapping module 90 degrees and moving in a second direction to perform multiple strapping operations on the items.

Further, the strapping method specifically comprising:

Step 1, moving the translational strapping module along the first direction and measuring a length dimension of the items to be strapped in the first direction, after the items to be strapped are conveyed below the support frame;

Step 2, calculating a strapping quantity and a strapping position of a strapping tape in the first direction, according to the measured length dimension information of the items to be strapped in the first direction;

Step 3, moving the translational strapping module in a reverse direction of the first direction, and bundling the strapping tape at the calculated strapping position on the items to be strapped;

Step 4, rotating the translational strapping module to rotate 90 degrees outside of the items to be strapped by a rotary module, and moving the translational strapping module in a second direction and measuring a length dimension of the items to be strapped in a second direction;

Step 5, calculating a strapping quantity and a strapping position in the second direction, according to the measured length dimension information of the second direction;

Step 6, moving the translational strapping module in a reverse direction of the second direction, and bundling the strapping tape at the calculated strapping position on the items to be strapped.

The present invention provides a rotary translational strapping apparatus and strapping method thereof, wherein, a rotary module drives a translational strapping module to move to meet the strapping requirements of different positions of the items to be strapped, and the rotary module drives the translational strapping module to rotate to meet the strapping requirements of items in different directions; during the strapping process, the items to be strapped do not need to be moved, and only the rotation and movement of the translational strapping module needs to be driven by the rotary module to meet the requirements of vertical cross-strapping on the surface of the items, so that, there is no need to configure two strapping apparatuses, on the one hand, the operating cost of the enterprise is reduced, and on the other hand, the rotary translational strapping apparatus occupies a smaller area than the two apparatuses.

EMBODIMENTS OF THE INVENTION

Figure 1:
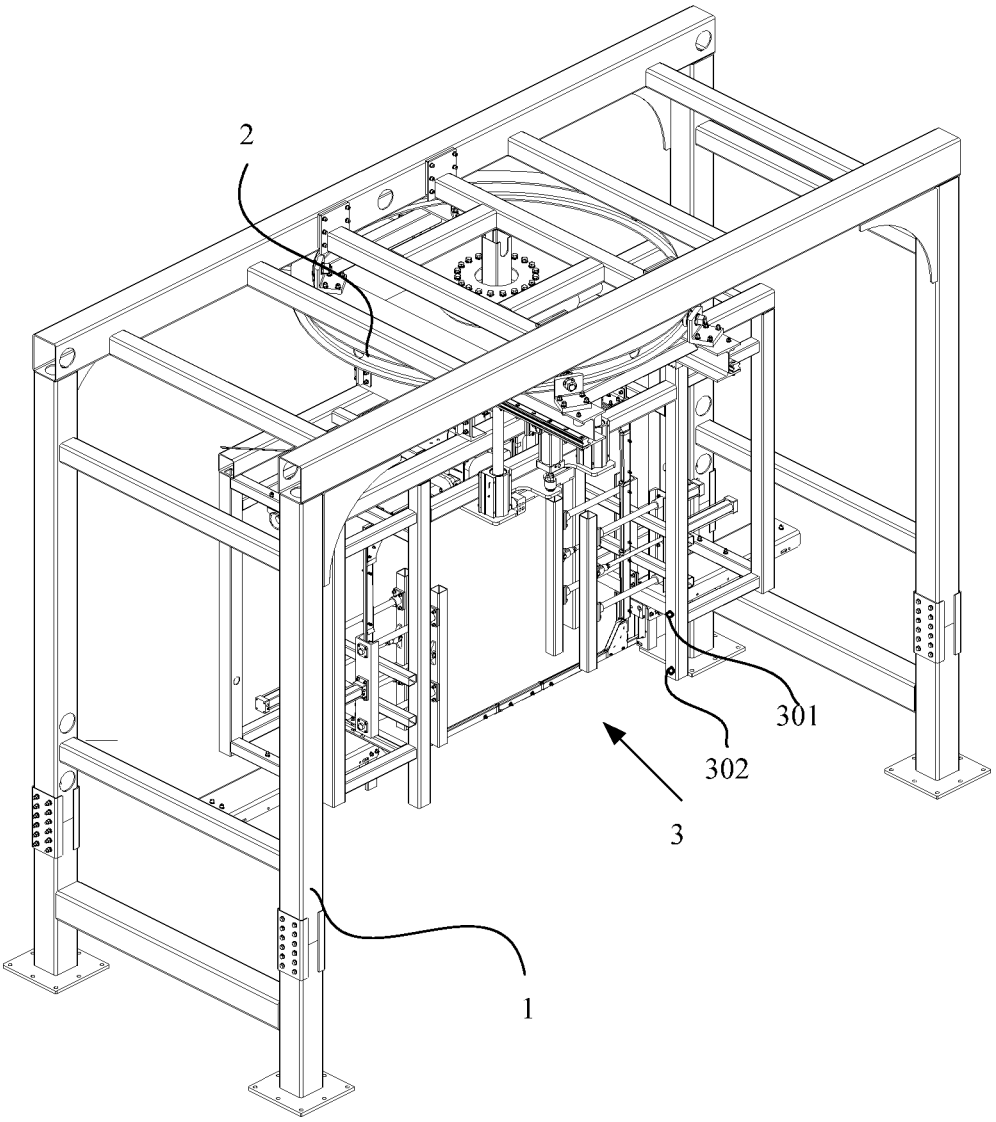
FIG. 1 is a first schematic structural view of the rotary translational strapping apparatus of the present invention.
Figure 2:
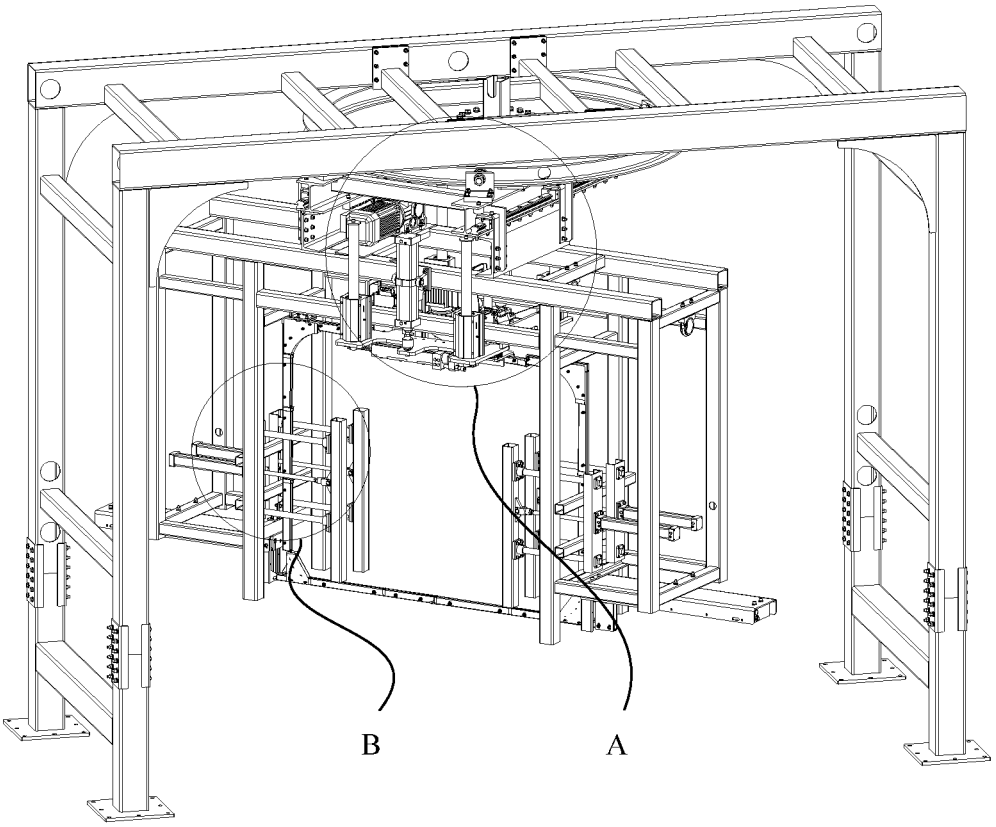
FIG. 2 is a second schematic view of the rotary translational strapping apparatus of the present invention.
Figure 3:
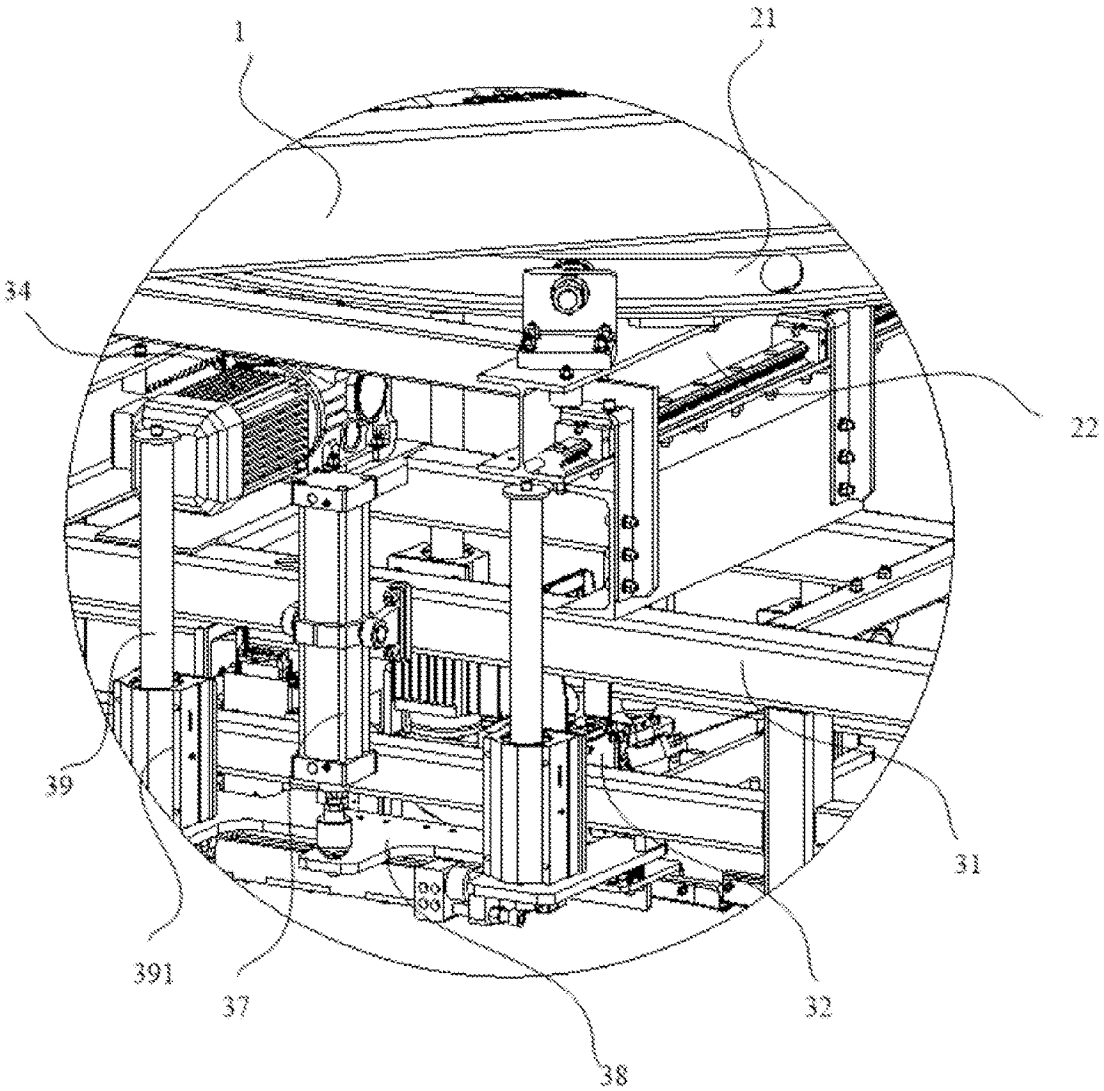
FIG. 3 is an enlarged fragmentary view of area A of FIG. 2.
Figure 4:
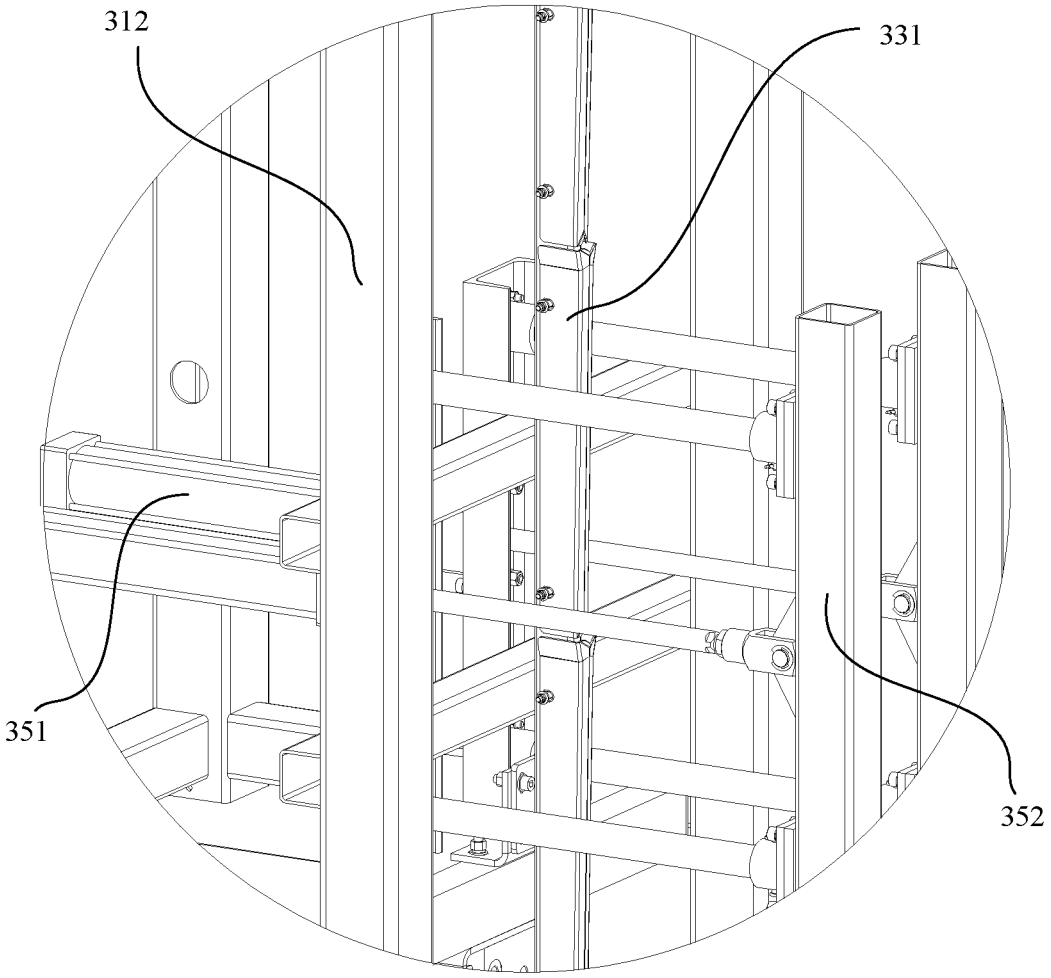
FIG. 4 is an enlarged fragmentary view of area B in FIG. 2.
Figure 5:
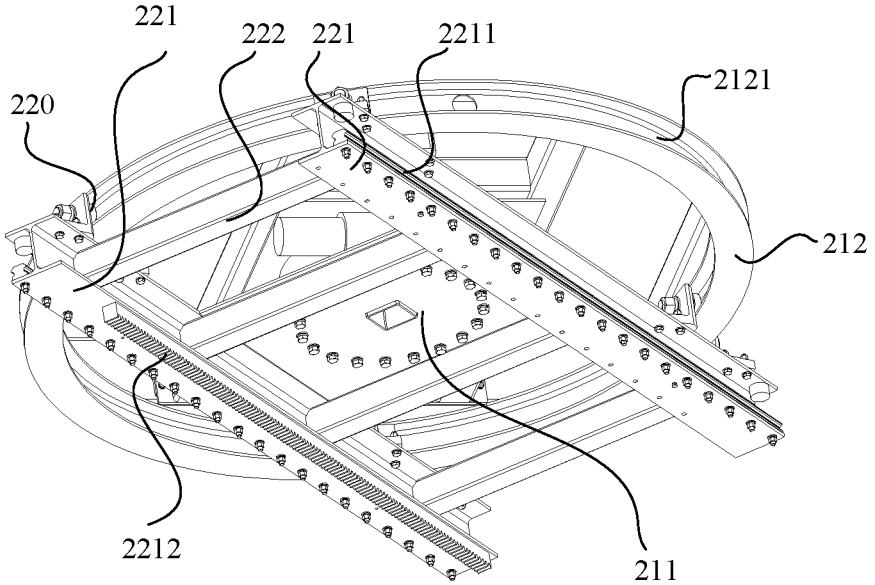
FIG. 5 is a schematic structural view of a rotary module of the rotary translational strapping apparatus of the present invention.
Figure 6:
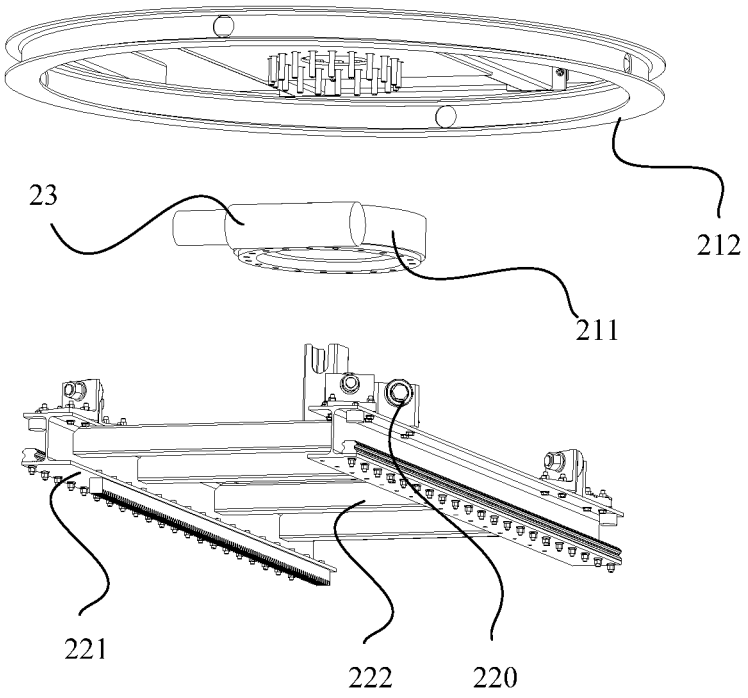
FIG. 6 is an exploded view of the rotary module of the rotary translational strapping apparatus of the present invention.
Figure 7:
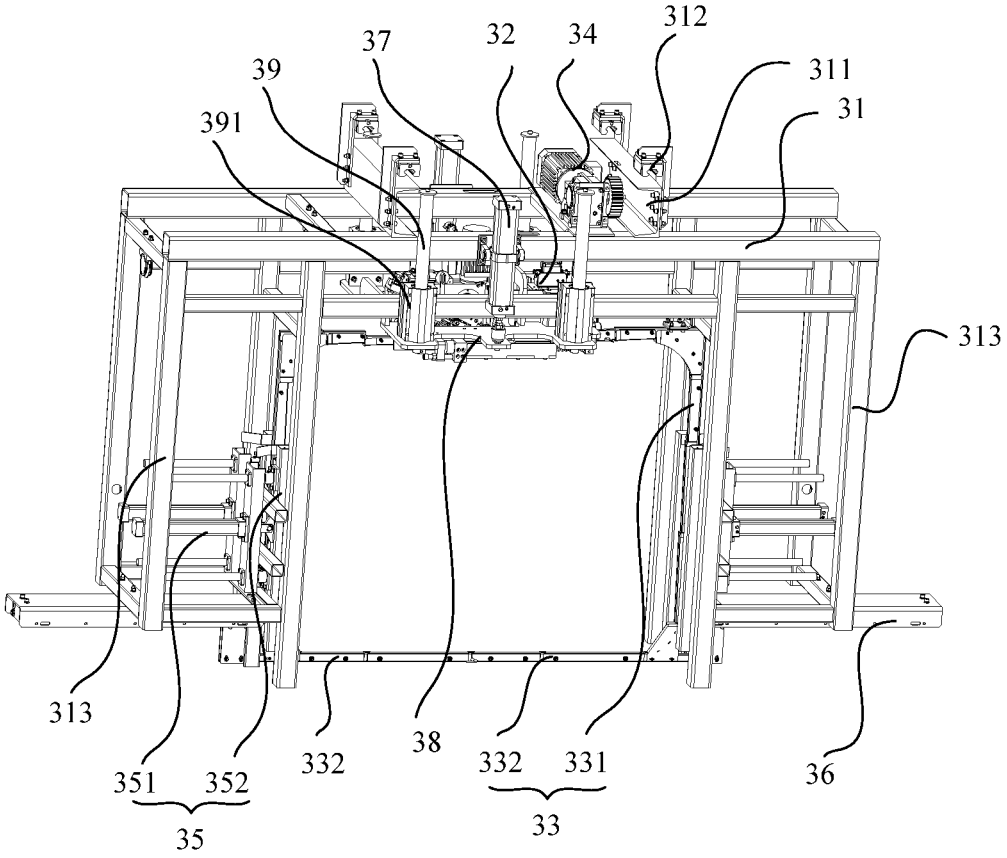
FIG. 7 is a schematic structural view of a translational strapping module of the rotary translational strapping apparatus of the present invention.

As shown in FIGS. 1-7, the present invention provides a rotary translational strapping apparatus, comprising:

support frame 1;

a rotary module 2 comprising a rotary guide 21, a rotary frame 22 and a first driving mechanism 23, the rotary guide 21 is disposed on a top of the support frame 1, the rotary frame 22 is rotatably disposed on the rotary guide 21, the first driving mechanism 23 is used for driving the rotary frame 22 to rotate relative to the rotary guide 21;

a translational strapping module 3 comprising a sliding mount 31, a strapping head 32, a strapping chute 33 and a second driving mechanism 34, the sliding mount 31 is slidably disposed on the rotary frame 22, the strapping head 32 is disposed on the sliding mount 31 and which is movable up and down, the strapping chute 33 is disposed on the sliding mount 31, the second driving mechanism 34 is used to drive the sliding mount 31 to reciprocate relative to the rotary frame 22.

In actual use, the strapping head 32 is supplied with a strapping tape from an outer strapping material dispenser for strapping, and the specific structure of the strapping head 32 may be referred to as a strapping head in a conventional strapping machine, which is not limited or described herein. At the same time, as far as the strapping chute 33 used in conjunction with the strapping head 32 is concerned, it is used for the transmission of the strapping tape output from the strapping head 32, and in the process of tightening the strapping by the strapping head 32, the strapping tape can be released from the strapping chute 33 and bound to the surface of the items to be strapped. Likewise, for the specific structural form of the strapping chute 33, which may be referred to the strapping chute structure in a conventional baler, which will not be limited or described herein.

During the strapping process, the requirement for rotation of the translational strapping module 3 is satisfied by the rotary module 2, and the translational strapping module 3 can drive the strapping head 32 and the strapping chute 33 to translate. Furthermore, the translational strapping module 3 can be rotated around the items to be strapped to meet the strapping requirements in two mutually perpendicular directions, and at the same time, the translational strapping module 3 can move along the items to be packed to form multiple strapping tapes on the items. The specific process is as follows: the items to be strapped are transported to the strapping station formed by the support frame 1 through a conveyor line or a forklift, and the translational strapping module 3 is driven by the rotary module 2 to move along the first direction (such as length direction) of the items to be strapped, and multiple strapping operations are performed on the items at a set distance apart, so that a required number of strapping tapes are bundled on the items; then, the translational strapping module 3 is driven to rotate on the outside of the items by the rotary module 2, so that the translational strapping module 3 rotates to a second direction (such as width direction), and then the translational strapping module 3 moves in the width direction, and completes the binding requirements of the plurality of strapping tapes in the second direction.

During the strapping process, the items to be strapped do not need to be moved, and only the translational strapping module 3 needs to be driven to rotate and move by the rotary module 2, which can meet the requirements of vertical cross-strapping on the surface of the items, so that there is no need to configure two strapping apparatuses, on the one hand, the operating cost of the enterprise is reduced, and on the other hand, the rotary translational strapping apparatus occupies a smaller area than the two apparatuses.

Further, since the overall weight of the translational strapping module 3 is relatively heavy, in order to ensure that the translational strapping module 3 can be carried by the rotary module 2 stably and reliably and drive it to rotate, the rotary guide 21 includes a swivel bearing 211 having a fixed portion disposed on the top of the support frame 1, and the rotary frame 22 is disposed on the revolving portion of the swivel bearing 211. Specifically, the swivel bearing 211 has smooth rotational performance and good load bearing capability, the swivel bearing 211 can carry the overall weight of the translational strapping module 3 by the swivel bearing 211, so that the rotary frame 22 is driven to rotate by the first driving mechanism 23 to meet the rotational requirements of the translational strapping module 3.

Preferably, in order to further improve the stability of rotation and the safety of use, the rotary guide 21 further includes an annular slide rail 212, the annular slide rail 212 is surrounding the exterior of the swivel bearing 211 and disposed on top of the support frame 1, and the rotary frame 22 is slidably disposed on the annular slide rail 212. The annular slide rail 212 is located at the periphery of the swivel bearing 211 and is used to guide the rotation of the rotary frame 22, the annular slide rail 212 is used to guide the rotation of the rotary frame 22 while the annular slide rail 212 is used to assist the rotary frame 22 with load bearing weight, and further it is more advantageous for improving the rotation stability and use safety reliability of the rotary frame 22. The annular slide rail 212 is provided with an annular guide groove 2121, the rotary frame 22 is provided with a roller 220, and the roller 220 is positioned in roller 220 in the annular guide groove 2121 to roll. Specifically, the rotating frame 22 meets the requirements of guide sliding and bearing weight by configuring the rollers 220 to cooperate with the annular guide groove 2121 on the annular slide rail 212. Wherein, the annular slide rail 212 may be processed by using steel components such as I-beams.

Still further, for the rotary frame 22, the translational strapping module 3 is carried thereon, and can meet the sliding requirements of the translational strapping module 3. To this end, the rotary frame 22 may include two cross beams 221 and at least one reinforcement beam 222, the reinforcement beam 222 is connected between the two cross beams 221; each cross beam 221 is provided with a guide rail 2211 on which a sliding mount 31 is slidably disposed. Specifically, the reinforcement beam 222 is welded between the two cross beams 221, and the reinforcement beam 222 is connected to the rotating portion of the swivel bearing 211 by bolting or the like, at the same time, the roller 220 is mounted at the end of the cross beam 221, so that the cross beam 221 rides on the annular slide rail 212. A guide rail 2211 is provided on the cross member 221 for guiding the sliding movement of the sliding mount 31 in the translational strapping module 3, thereby ensuring a smooth sliding movement of the sliding mount 31. Wherein, the top of the sliding mount 31 is provided with two oppositely disposed mounting brackets 311, the mounting brackets 311 are provided with sliders 312, and the sliders 312 are slidably disposed on a corresponding guide rail 2211.

Further, in order to meet the installation requirements of the strapping chute 33, two ends of the sliding mount 31 are provided with downwardly extending connection bracket 313, and the strapping chute 33 includes two side belt grooves 331 and two bottom belt grooves 332, the side belt grooves 331 are distributed on two sides of the strapping head 32 and are oppositely disposed, the side belt grooves 331 are provided vertically on the connection bracket 313 on the corresponding sides. Wherein, a lower end of at least one of the side belt grooves 331 is provided with a laterally arranged bottom belt groove 332. Specifically, the sliding mount 31 is integrally constructed with a frame structure, and two sides of the sliding mount 31 are provided with corresponding connection brackets 313, the connection brackets 313 extend downwardly from the top of the sliding mount 31, so that satisfying the requirement that the side belt grooves 331 be installed longitudinally, and at the same time, the bottom belt groove 332 is installed laterally at the bottom of the connection brackets 313. In the actual use process, the bottom belt groove 332 can be respectively provided on a bottom of the side belt grooves 331, so that the bottom channel groove 332 on two sides move in opposite directions during strapping; or, the bottom belt groove 332 can be provided on the bottom of one side belt groove 331, so that the bottom channel groove 332 on only one side move during strapping. Eventually, a complete endless loop-like channel is formed by the strapping head 32, the side belt groove 331 and the bottom belt groove 332, and which is used to transport the strapping tape.

Hereinafter, the configuration of the two bottom belt grooves 332 is taken as an example for description. For the conveying path of the strapping tape, the strapping tape is supplied to the strapping head 32 by the outer strapping material dispenser, the strapping head 32 first transports the strapping tape to one side belt groove 331, the strapping tape output from the strapping head 32 passes through the other side belt groove 331 and the bottom belt groove 332 under this side are conveyed, then enter the bottom belt groove 332 under the other side and enter the side belt groove 331 on the corresponding side upward, and eventually, the strapping tape is returned to the strapping head 32. The conveying method for the strapping tape is similar to that of the strapping tape in the conventional strapping machine, and will not be limited or described herein.

Wherein, in order to position the strapped items during the strapping process, a positioning assembly 35 is further provided on the connection bracket 313, the positioning assembly 35 includes a first telescopic mechanism 351 and a pressing member 352, the first telescopic mechanism 351 is laterally provided on the connection bracket 313, the pressing member 352 is provided on the moving portion of the first telescopic mechanism 351, the pressing member 352 is located on one side of the side belt grooves 331. Specifically, when the items are strapped, the items will be positioned between the two connection brackets 313, and then the first telescopic mechanism 351 on both sides are actuated to make the pressing member 352 abut against the side of the items, thereby realize the strapping and positioning of items. The representation entity of the first telescopic mechanism 351 may adopt a structural form such as an air cylinder, an electric push rod, or an oil cylinder.

In addition, during the rotation and movement of the translational strapping module 3, in order to prevent the bottom belt groove 332 from hitting the pad on the bottom tray of the items, a retractable structure design is adopted for the bottom belt groove 332, specifically: the bottom of the connection bracket 313 is provided with a laterally disposed second telescopic mechanism 36, the bottom belt groove 332 is provided on the moving portion of the second telescopic mechanism 36; after the second telescopic mechanism 36 drives the bottom belt groove 332 to extend, the two bottom belt grooves 332 are butted together, and the bottom belt groove 332 is connected with the side belt groove 331 on the corresponding side. Specifically, the second telescopic mechanism 36 can drive the bottom belt groove 332 to move, so that the two oppositely disposed bottom belt grooves 332 move synchronously in the opposite direction. When strapping is required, the second telescopic mechanism 36 drives the bottom belt groove 332 to extend and moves toward the inside of the connection bracket 313, eventually, the two bottom belt grooves 332 are butted together; at the same time, the bottom belt groove 332 and the side belt groove 331 of the corresponding side are also connected. When it is necessary to rotate the translational strapping module 3, the second telescopic mechanism 36 drives the bottom belt groove 332 to retract, so that the bottom belt groove 332 is retracted to the inner side of the connection bracket 313, in this way, during the rotation of the translational strapping module 3, the connecting bracket 313 will rotate around the outside of the items, and at the same time, the bottom belt groove 332 will not touch the items. In order to satisfy the design of small size and compact equipment for the second telescopic mechanism 36, the second telescopic mechanism 36 preferably adopts a rod less cylinder, so that the overall size of the equipment can be minimized As for the strapping head 32, a third telescopic mechanism 37 and a lifting platform 38 are also provided on the sliding mount 31, and the third telescopic mechanism 37 is vertically arranged on the sliding mount 31, the lifting platform 38 is arranged on the moving portion of the third telescopic mechanism 37, and the strapping head 32 is arranged on the lifting platform 38, according to the height requirements of different items during the strapping process. Specifically, the third telescopic mechanism 37 can drive the lifting platform 38 up and down to meet the strapping requirements for different height sized items. Accordingly, in order to enable the lifting platform 38 to lift smoothly, the lifting platform 38 is provided with a guide rod 39 and a sliding sleeve 391 provided on the sliding mount 31.

Wherein, for the first driving mechanism 23 and the second driving mechanism 34, the driving force is typically provided by means of a motor, and in order to improve the accuracy of controlling the movement and rotation, a servo motor is preferably used to improve the accuracy. For example, a gear is disposed on the motor of the first driving mechanism 23, and a ring gear is disposed on the rotating portion of the swivel bearing 211, and the gear meshes with the ring gear for rotating the rotary frame 22. Likewise, the motor of the second driving mechanism 34 is also provided with a gear, the cross member 221 is provided with a gear rack 2212, and the gears mesh with the gear rack 2212 to realize the movement of the sliding mount 31.

In a preferred embodiment, in order to realize adaptive adjustment of the position and quantity of the strapping tapes, the sliding mount 31 is provided with a first detection module 301 for detecting the size of the items to be packed. Specifically, the first detection module 301 can detect the size of the items, and during the process of the sliding mount 31 moving along the item, the first detection module 301 can detect the size of the items in the direction during the first detection module 301 follows the sliding mount 31 to move; and then, it is strapped according to a predetermined strapping rule, based on the specific measured size. The rule setting for the strapping quantity of items of different sizes in a certain direction will not be limited or described herein.

At the same time, since the bottom of the items to be strapped is typically supported by a tray, the strapping tape requires passing through a forklift hole on the tray and simultaneously avoiding a pad in the bottom of the tray. Considering the influence of the tray, the sliding mount 31 is further provided with a second detection module 302 for detecting the position of the forklift holes on the tray carrying the items to be strapped, and in particular, during movement of the sliding mount 31 along the items, on the one hand, the first detection module 301 can detect the size of the items themselves, and the other hand, the second detection module 302 can also measure the tray under the items to determine the position of the forklift hole on the tray. In this way, during the strapping process, the strapping position and quantity of the strapping tape are determined according to the overall size of the item and the position of the forklift hole on the tray, so as to realize the self-adaptive strapping operation.

There are a variety of forms for the representation entities of the first detection module 301 and the second detection module 302. For example, the first detecting module 301 and the second detecting module 302 can use a photoelectric sensor, and the photoelectric sensor can detect whether there is an object blocking in front of the photoelectric sensor, so that, the size parameters of the items and the position of the forklift hole on the stray can be detected, according to the switch signal of the photoelectric sensor combined with the servo motor to drive the movement and displacement of the sliding mount 31. Alternatively, the first detection module 301 and the second detection module 302 can use an image collector (such as a camera), to obtain the physical dimensions of the object and the positions of the forklift holes and the pads on the tray using image recognition techniques, and the specific methods related to image processing may be referred to conventional image processing techniques, which are not limited or described herein.

Wherein, regarding the manner in which the above-mentioned motor output power realizes the transmission connection, the manner of adding a speed reducer to the rotating shaft of the motor may be adopted, which will not be limited or described herein.

The present invention also provides a strapping method for a rotary translation baler apparatus, specifically comprising: conveying the items to be strapped below the support frame 1, moving the translational strapping module 3 in a first direction, and performing multiple strapping operations on the item, and then rotating the translational strapping module 3 90 degrees and moving in a second direction to perform multiple strapping operations on the items.

Specifically: in the actual use process, items to be strapped are transported to the strapping station of the rotary translational strapping apparatus through a conveyor line or a forklift. By moving the translational strapping module 3, the strapping operation in the first direction is performed, and after the processing is completed, the translational strapping module 3 is rotated and the translational strapping module 3 continuously moved to perform the strapping operation in the second direction.

Wherein, the specific strapping operation includes the following steps:

Step 1, moving the translational strapping module 3 along the first direction and measuring a length dimension of the items to be strapped in the first direction, after the items to be strapped are conveyed below the support frame 1. The items are placed at the strapping station formed by the support frame 1, and then the rotary module 2 drives the translational strapping module 3 to move along the first direction of the items to measure the size of the items in the first direction by the first detection module 301.

Step 2, calculating a strapping quantity and a strapping position of a strapping tape in the first direction, according to the measured length dimension information of the items to be strapped in the first direction. After the translational strapping module 3 slides from one end of the slide rail toward the other end and the measurement is completed in step 1, the items are strapped at a certain distance at the periphery of the item by a specific number of the strapping tape, according to the size of the items in the first direction in combination with a predetermined strapping rule.

Step 3, moving the translational strapping module in a reverse direction of the first direction, and bundling the strapping tape at the calculated strapping position on the items to be strapped. Specifically, the translational strapping module 3 is driven to move in the opposite direction to strap the items in the first direction.

Step 4, rotating the translational strapping module 3 to rotate 90 degrees outside of the items to be strapped by a rotary module 2, and moving the translational strapping module 3 in a second direction and measuring a length dimension of the items to be strapped in a second direction. After the strapping operation in the first direction is completed, the translational strapping module 3 needs to be rotated, so that the translational strapping module 3 is rotated to the second direction for cross strapping processing. After the translational strapping module 3 completes the strapping operation in the first direction, it moves to one end of the slide rail to avoid the items, and then rotates 90 degrees again.

Step 5, calculating a strapping quantity and a strapping position in the second direction, according to the measured length dimension information of the second direction. When strapping in the second direction, after measuring the size of the items in the second direction at step 4, the strapping position and the number of times of strapping in the second direction are calculated again.

Step 6, moving the translational strapping module in a reverse direction of the second direction, and bundling the strapping tape at the calculated strapping position on the items to be strapped.

Further, considering the influence of the bottom tray of the items during the strapping process, the step 1 further includes: detecting a location of a forklift hole on the bottom tray of the items to be strapped in the first direction, during the movement of the translational strapping module 3 along the first direction. Specifically, the position of the forklift hole in the first direction of the tray is detected by the second detection module 302, and when calculating the strapping position, the pad of the tray is avoided so that the strapping tape passes through the forklift hole for strapping. Correspondingly, the step 2 further includes: calculating the number of bundling and the strapping position of the strapping tape in the first direction, according to the measured length and dimension information of the items to be strapped and the position information of the forklift hole in the first direction.

Similarly, in the process of strapping the items in the second direction, the step 4 further includes: detecting a position of a forklift hole in the bottom tray of the items to be strapped in the second direction, during movement of the translational strapping module 3 in the second direction; and the step 5 further includes: calculating a number of bunding and a strapping position of strapping tape in the second direction, according to the measured length dimension information of the items to be strapped and the forklift hole position information in the second direction.

Figure 8:
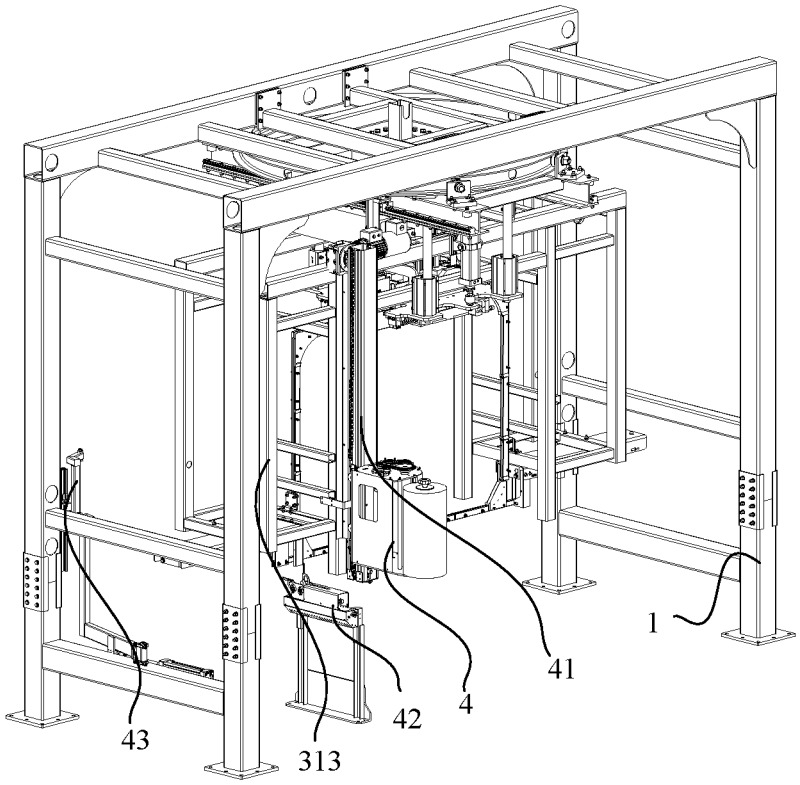
FIG. 8 is third schematic view of the rotary translational strapping apparatus of the present invention.

Based on the above technical solution, optionally, in another embodiment of the present invention, in order to achieve the functional integrated design, after the items are strapped, a film wrapping process is performed on the surface of the items, as shown in FIG. 8, and a film wrapping module 4 is provided on one of the connection brackets 313 for conveying the film outwardly and wrapping the film around the items to be strapped. In actual use, after the strapping operation is completed on the items by the translational strapping module 3; a rotation of the rotary module 2 can be followed by the sliding mount 31, and the film is transferred outwardly by the film wrapping module 4 during the rotation of the sliding mount 31, so that can wrap the film on the strapped items and thereby achieve the automatic wrapping operation. The film wrapping module 4 utilizes the rotational function of the sliding mount 31 to achieve automatic film wrapping, which diverges the function of the apparatus, provides a higher degree of integration, reduces the number of purchases provided in the factory floor, and advantageously reduces the footprint of the apparatus. Wherein, the performance entity of the film wrapping module 4 may be a conventional apparatus, such as a film dispenser in a strapping machine for wrapping a plastic film net around an item disclosed in Chinese Patent No. 2004100353283, of course, those skilled in the art can also use other apparatus capable of transporting the film outwards according to actual needs, which will not be limited or described herein.

Here, in order to film items of different heights, a lifting mechanism 41 is provided on the connection bracket 313, and the lifting mechanism 41 can move the film wrapping module 4 up and down to meet the film wrapping requirements of items of different heights. In addition, the bottom portion is further provided with a clamping mechanism 42 for clamping the end of the film during wrapping of the items, the clamping mechanism 42 clamps the free end of the film, and then, during turning of the film wrapping module 4, to enable the film to be more tightly wrapped around the surface of the items. Similarly, in order to achieve automatic film breaking, a film breaking mechanism 43 is provided to automatically cut the film after it has been wound. With respect to the embodied entities of the clamping mechanism 42 and the film breaking mechanism 43, reference may be made to a related configuration in a strapping machine for wrapping a plastic film net around an item disclosed in Chinese Patent No. 2004100353283, which is not limited or described herein.

For the first direction and the second direction described in the above embodiments, the length direction of the items may be the first direction, and the width direction of the items may be the second direction, which is not limited herein.

The invention claimed is:

1. A rotary translational strapping apparatus, comprising:

a support frame;

a rotary module comprising a rotary guide, a rotary frame and a first driving mechanism, the rotary guide is disposed on a top of the support frame, the rotary frame is rotatably disposed on the rotary guide, the first driving mechanism is configured for driving the rotary frame to rotate relative to the rotary guide;

a translational strapping module comprising a sliding mount, a strapping head, a strapping chute and a second driving mechanism, in which the sliding mount is slidably disposed on the rotary frame, the strapping head is disposed on the sliding mount and which is movable up and down, the strapping chute is disposed on the sliding mount, the second driving mechanism is configured to drive the sliding mount to reciprocate relative to the rotary frame, wherein a first detection module for detecting a size or a position of items to be strapped is disposed on the sliding mount;

wherein two ends of the sliding mount are provided with downwardly extending connection brackets;

wherein side belt grooves are vertically disposed on the connection brackets on the respective sides;

wherein a lower end of at least one of the side belt grooves is provided with a laterally disposed bottom belt groove.

2. The rotary translational strapping apparatus according to claim 1, wherein the sliding mount is further provided with a second detection module for detecting a position of a forklift hole on a tray carrying items to be strapped.

3. The rotary translational strapping apparatus according to claim 1, wherein the rotary guide comprises a swivel bearing, the fixed portion of the swivel bearing is disposed on a top of the support frame, and the rotary frame is disposed on a rotating portion of the swivel bearing.

4. The rotary translational strapping apparatus according to claim 3, wherein the rotary guide further comprises an annular slide rail, the annular slide rail is surrounded on an exterior of the swivel bearing and is disposed on a top of the support frame, the rotary frame is also slidably disposed on the annular slide rail.

5. The rotary translational strapping apparatus according to claim 1, wherein a bottom of the connection bracket is provided with a laterally arranged second telescopic mechanism, and the bottom belt groove is provided on a moving portion of the second telescopic mechanism.

6. The rotary translational strapping apparatus according to claim 5, wherein the sliding mount is further provided with a third telescopic mechanism and a lifting platform, the third telescopic mechanism is provided vertically on the sliding mount, the lifting platform is provided on a moving portion of the third telescopic mechanism, the strapping head is provided on the lifting platform.

7. The rotary translational strapping apparatus according to claim 1, wherein a film wrapping module is provided on the connection brackets for conveying the film outwardly and wrapping the film around the items to be strapped.

8. A strapping method for a rotary translational strapping apparatus as claimed in claim 1, comprising: conveying the items to be strapped below the support frame, moving the translational strapping module in a first direction, and performing multiple strapping operations on the item, and then rotating the translational strapping module 90 degrees and moving in a second direction to perform multiple strapping operations on the items.

9. The strapping method according to claim 8, comprising:

Step 1, moving the translational strapping module along the first direction and measuring a length dimension of the items to be strapped in the first direction, after the items to be strapped are conveyed below the support frame;

Step 2, calculating a strapping quantity and a strapping position of a strapping tape in the first direction, according to the measured length dimension information of the items to be strapped in the first direction;

Step 3, moving the translational strapping module in a reverse direction of the first direction, and bundling the strapping tape at the calculated strapping position on the items to be strapped;

Step 4, rotating the translational strapping module to rotate 90 degrees outside of the items to be strapped by a rotary module, and moving the translational strapping module in a second direction and measuring a length dimension of the items to be strapped in a second direction;

Step 5, calculating a strapping quantity and a strapping position in the second direction, according to the measured length dimension information of the second direction;

Step 6, moving the translational strapping module in a reverse direction of the second direction, and bundling the strapping tape at the calculated strapping position on the items to be strapped.

* * * * *